US005456562A

United States Patent [19]

Schlecker et al.

[11] Patent Number: 5,456,562

[45] Date of Patent: Oct. 10, 1995

[54] PARKING DEVICE

[75] Inventors: Helmut Schlecker, Plochingen; Jutta Hohn, Flein; Dirk Coolens, Leonberg-Eltingen, all of Germany

[73] Assignee: Thyssen Aufzüge GmbH, Neuhausen, Germany

[21] Appl. No.: 152,265

[22] Filed: Nov. 12, 1993

[30] Foreign Application Priority Data

Nov. 12, 1992 [DE] Germany ..... 42 37 742.0
Nov. 13, 1992 [DE] Germany ..... 42 38 322.6

[51] Int. Cl.[6] ..... E04H 6/06

[52] U.S. Cl. ..... 414/254; 414/256; 414/264

[58] Field of Search ..... 414/253–256, 414/262, 264, 281–283

[56] References Cited

U.S. PATENT DOCUMENTS

| | | | |
|---|---|---|---|
| 2,598,413 | 5/1952 | Morley | 414/254 X |
| 2,799,406 | 7/1957 | Alimanestiano | 414/254 X |
| 2,838,186 | 6/1958 | Alimanestiano | 414/254 |
| 3,786,930 | 1/1974 | Obregon | 414/254 X |
| 3,896,955 | 7/1975 | Collins et al. | 414/254 |
| 4,534,692 | 8/1985 | Shiomi et al. | 414/282 |
| 4,883,401 | 11/1989 | Kavieff | 414/281 X |
| 5,243,796 | 9/1993 | Casini | 414/256 X |

FOREIGN PATENT DOCUMENTS

| | | | |
|---|---|---|---|
| 603913 | 4/1960 | Italy | 414/254 |
| 88853 | 3/1990 | Japan | 414/254 |
| 1208166 | 10/1970 | United Kingdom | 414/254 |

*Primary Examiner*—David A. Bucci
*Attorney, Agent, or Firm*—John C. Thompson

[57] ABSTRACT

A parking device contains parking boxes (20) for parking cars in two high storage racks arranged to either side of a conveying floor (14). A hoisting appliance (64) is longitudinally movable on the floor (14) between the high storage racks has a vertically and telescopingly horizontally adjustable conveying table (70). At the side of a rack (10) opposite the floor an entrance and departure station (24) is disposed having rest combs (30) projecting from both outer sides into the car track areas, between which complementary transport combs (36) of a shiftable lifting table (34) can be moved vertically and from there horizontally in relation to a parking box (20) formed as a transition place (50). Transition place (50) and all parking boxes (20) contain rest combs (51 and 86 respectively) on both sides, which interact with transport combs (80) fitted on both sides of the hoisting appliance conveying table (70) for receiving and transferring of cars.

19 Claims, 9 Drawing Sheets

PARKING DEVICE

TECHNICAL FIELD

The invention concerns a parking device for cars, comprising vertical racks erected on both sides of a floor, along which a hoisting appliance is movable, said racks containing parking boxes arranged adjacently and above each other in several levels, wherein the parking boxes and a conveying table of the hoisting appliance have rest areas formed by a comb system consisting of prongs and the stationary rest combs of the parking boxes are vertically traversed by complementarly staggered transport combs of the conveying table for the purpose of transferring and/or receiving a car.

The demand for parking devices of any kind is growing rapidly due to the constantly increasing number of cars on the road. In providing additional parking places conventionally designed passable parking houses often must be disregarded as a possible solution, this being due primarily to the large area required, but also due to other disadvantages including danger of active or passive car damage, burglary, theft, environmental pollution by exhaust fumes and noise, and long access durations at rush hours. On the other hand, in order to reduce the area required, proposals have been documented to house cars in mechanized high storage rack systems. In practice, however, such storage systems remained unaccepted, because the periods required to retrieve cars are too long and the investment costs too high in view of the considerable technical requirements.

The problem underlying the present invention is to provide a mechanized, highly automated parking device for cars, which characterizes by very small area and space requirements as well as low installation costs, and which, by using the latest mechanical and structural engineering techniques, renders particularly short access times and enables to also meet the environmental requirements.

According to the inventional solution of this problem one parking box of a rack forms a transition place between a conveying table, which can be brought up from one side, and a shiftable lifting table fitted with transport combs, which can be brought up from the opposite side and is guided and driven to carry out vertical movements relative to stationary rest combs of an entrance and departure station, installed at the end of the transition place opposite the floor, and relative to the transition place for receipt or delivery of a car, and to carry out horizontal movements between transition place and an entrance and departure station, hereinafter referred to as an E/D station, and in that the comb system consists of two groups of prongs, each arranged in car track areas and as stationary rest combs extending from side support members of the rest areas of the parking box, of the transition place, and of the E/D station up to a central free area provided for vertical movement of and/or for receiving the conveying table and the shiftable lifting table, respectively, from both longitudinal sides of which extend transport combs projecting into the car track area and complementarily staggered with respect to the stationary rest combs.

BACKGROUND OF THE INVENTION

SUMMARY OF THE INVENTION

This kind of parking devices, in which steel construction parts are extensively used for the rack beams, shelving system and/or rest areas, hoisting appliance, and in the entrance and departure station, can be installed in an independent car park or in a part of a building complex of hotels, office or residential buildings, or can be integrated hospitals, old people's homes and other existing building complexes, since they function without exhaust pollution and with a minimum of noise generation. Moreover the maneuvering, which normally takes place in car parks when parking and retrieving vehicles, disappears particularly if the cars, when prepared for leaving are placed in their departing direction.

A low noise level is achieved by the conveying principle throughout used from an entrance and departure station up to the high storage racks and back, wherein the shiftable lifting table by means of its transport combs takes up a car from the rest combs and by moving through the rest combs of the transition place, deposits it there, while the hoisting appliance by means of the transport combs of its conveying table lifts a car from the transition place and deposits it on the rest combs of an allocated parking box.

The incoming car can activate the opening mechanism of a rolling gate or a barrier at the entrance and departure stations by driving over an induction loop and is then driven on the rest combs to a pre-determined position, in which preferably its front wheels are received in a recess provided by greater prong intervals and/or may be positioned by using sensor and signalling devices such that they can be positionedly taken up in appropriate receiving means or depressions of the transport combs of the shiftable lifting table. This positioning principle which is extended to the transition place, the hoisting appliance conveying table and the rest combs and parking boxes, facilitates a simple and safe handling procedure for moving driverless cars.

Depending on the number of parking boxes available in the parking device and also on the length of the storing racks, several entrance and departure stations with allocated transition places may be provided in the adjacent bay and additionally several hoisting appliances passable in the conveying floor, this for the purpose of effectively reducing the access time. During periods of increased user frequency, for example work start time, the majority of stations can be programmed only as entrance station. Preferably, there are two hoisting appliances along each conveying floor, passable past each other on rails, the conveying table of which having a hoisting platform guided on one or two masts and a telescoping table, rotatable through at least 180° by means of a pivot bearing and telescopingly movable horizontally on or into opposite direction, transport combs being fixed to the sides of upper, farthest extensible telescoping unit. For parking devices having very long conveying floors and several entrance/departure stations, more than one hoisting appliance can be provided on each pair of rails formed by one upper and one lower rail.

The transport combs fixed to the shiftable lifting table and to the hoisting appliance conveying table have, as a result of greater prong intervals, first receiving means for positioning preferably the car front wheels, whilst the rest combs in the parking boxes, the transition place and the entrance/departure stations also have receiving means formed by prongs of smaller intervals fitting between the prongs of the first receiving means or formed by trough sections upwardly open. If required, the receiving means or recesses can be established or removed, respectively, by means of vertically adjustable prongs.

For loading and unloading of bays arranged completely underground, at least one entrance and departure station is provided above ground at entrance level, and having a shiftable lifting table vertically adjustable within a pit, designed to suit the largest car dimensions, between entrance height and a minimum height for then being displaced at a level underneath the transition place, whilst the rest combs of the E/D station are adjustable between a clearing position to open the pit and a closing position partly to cover the pit. By carrying out this proposal, the high storage rack parking system with its advantages as to effecient utilization of space, may be constructed underground, wherein simply one or several E/D stations with roofs or in the form of small garage building remain visible over a green free area at entrance height. The rest combs in the E/D stations to clear the pit either are moved horizontally into the pit side boundaries or folded downwards. The shiftable lifting table with a car standing on it is adjustable to an upper end position located above the entrance level, at which the rest combs can be adjusted freely between their clearing and closing positions.

In providing a simplified parking device, at least one transition place installed in a parking box may be positioned at entrance height and used as an E/D station having both rest combs and rolling gates. This variant is used either exclusively or in combination with a parking device which has at least one other transition place behind a E/D station. Provision can also be made such that only cars placed ready for leaving at a transition place are collected from here by the driver and driven out via a lane continuing up to the rest combs of the entrance and departure station.

According to another simplified embodiment of the inventional parking device, at the height of a passable roof above the conveying floor, at least one E/D station is provided with rest combs being disposed above an opening designed to suit the largest car dimensions and interacting with transport combs of the hoisting appliance telescoping table, which can be moved to a correspondingly aligning or fitting height, while the rest combs can be retracted into the side opening boundaries or folded downwards by means guided drive means.

Further features and advantages of the parking device according to the invention will become apparent from the following description of embodiments shown in the drawings, which also contain details essential to the invention. These features, including those of the claims may form alternative embodiments of the invention either individually or in any other combination.

DETAILED DESCRIPTION

Figure 1:
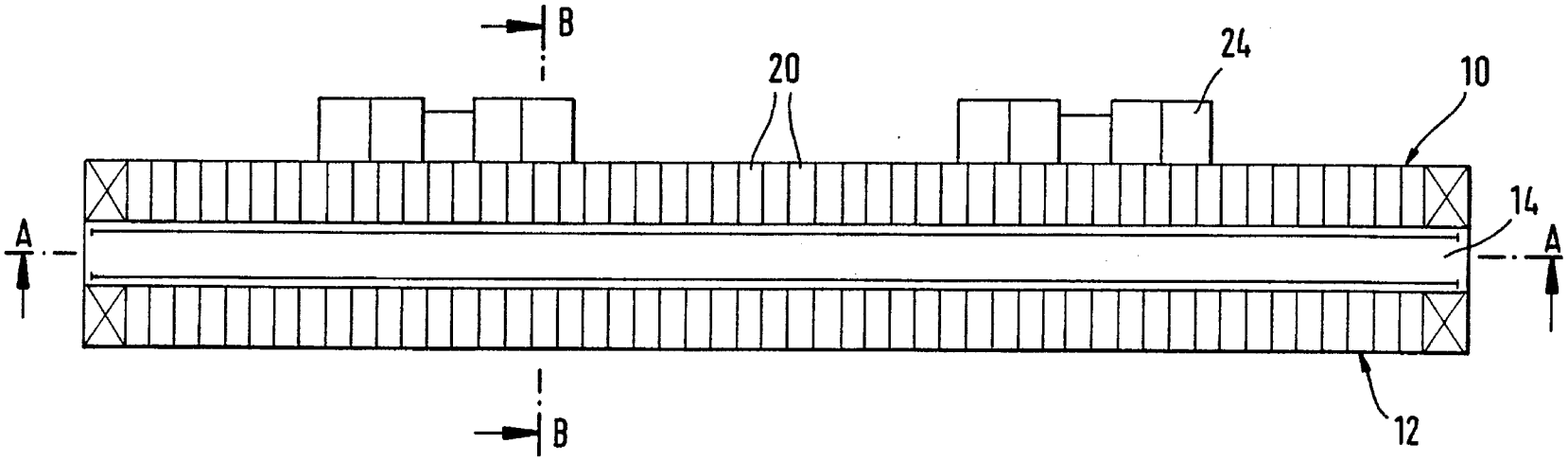
FIG. 1 is a top view of a parking device in accordance with the invention.
Figure 2:
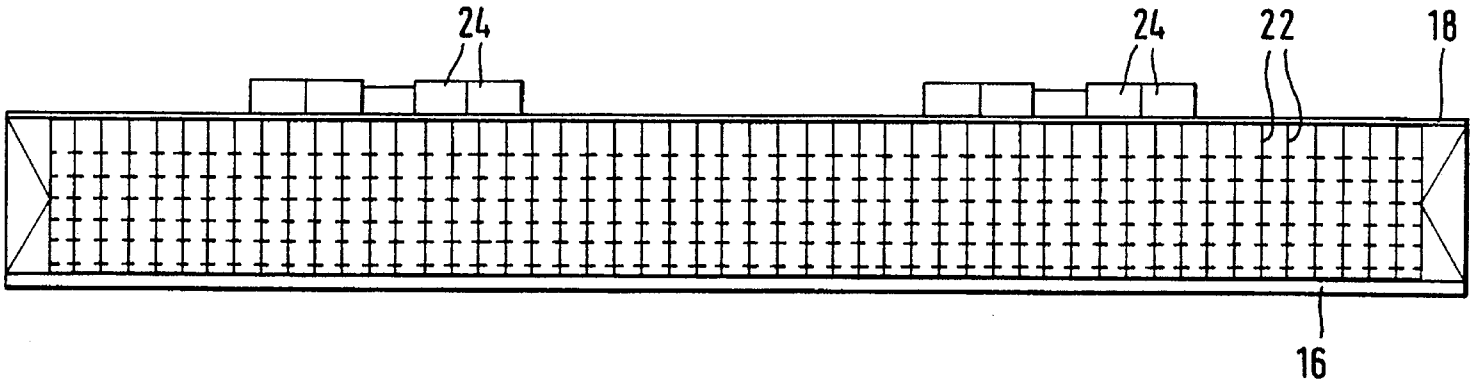
FIG. 2 is a vertical longitudinal section following line A—A in FIG. 1.
Figure 3:
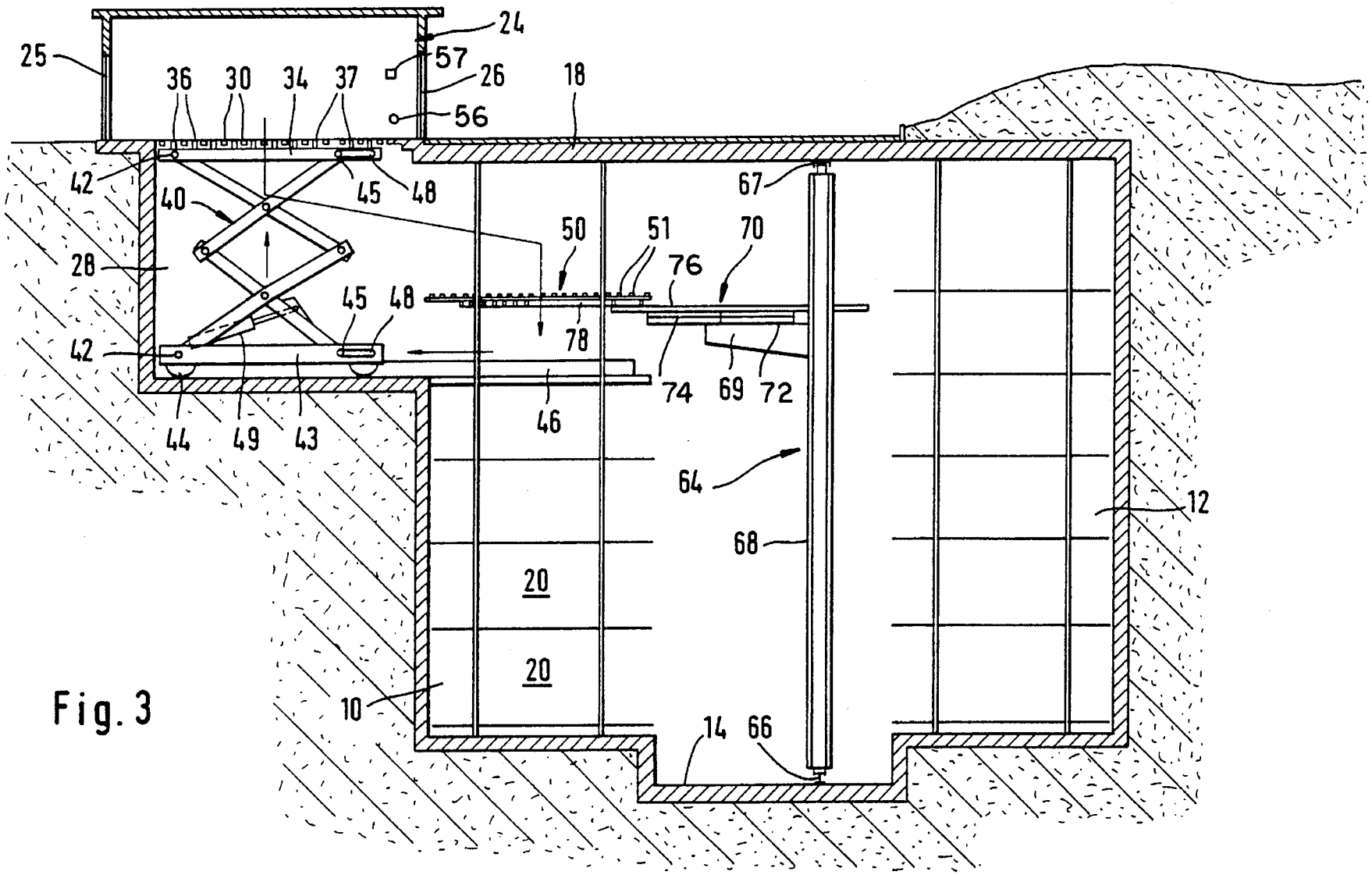
FIG. 3 is an enlarged vertical section following line B—B in FIG. 1 showing an entrance and departure station at the height of a passable roof.

According to FIG. 1 and 2, two racks 10, 12 of any length consisting preferably of metal profiles, are installed parallel to each other on both sides of a conveying floor 14 in a car park, which in the example shown in FIG. 2 is located underground, has a base 16 and is closed to above by a passable roof 18, which can be used as an additional parking area or by grassing or covering with a layer of top-soil. Each rack 10, 12 contains horizontal rows of parking boxes or bays 20, arranged longitudinally adjacent each other and fitted with rest areas, and being disposed above each other to groups between vertical beams 22, wherein more spacious parking boxes, e.g. in the uppermost and lowermost rows are used for parking off-roaders or vehicles having roof superstructures. At the entrance level, which in FIG. 2 and 3 is located above the passable roof 18 and in FIG. 4 at an interim height, several covered entrance and departure stations 24 are provided at the side next to rack 10 having front and rear rolling gates or barriers, 25 and 26 respectively. Rear exits and barriers 26 are unnecessary in FIG. 3 if the departing cars are turned through 180 degrees within the parking system and leave station 24 in the opposite direction to which they entered.

Figure 4:
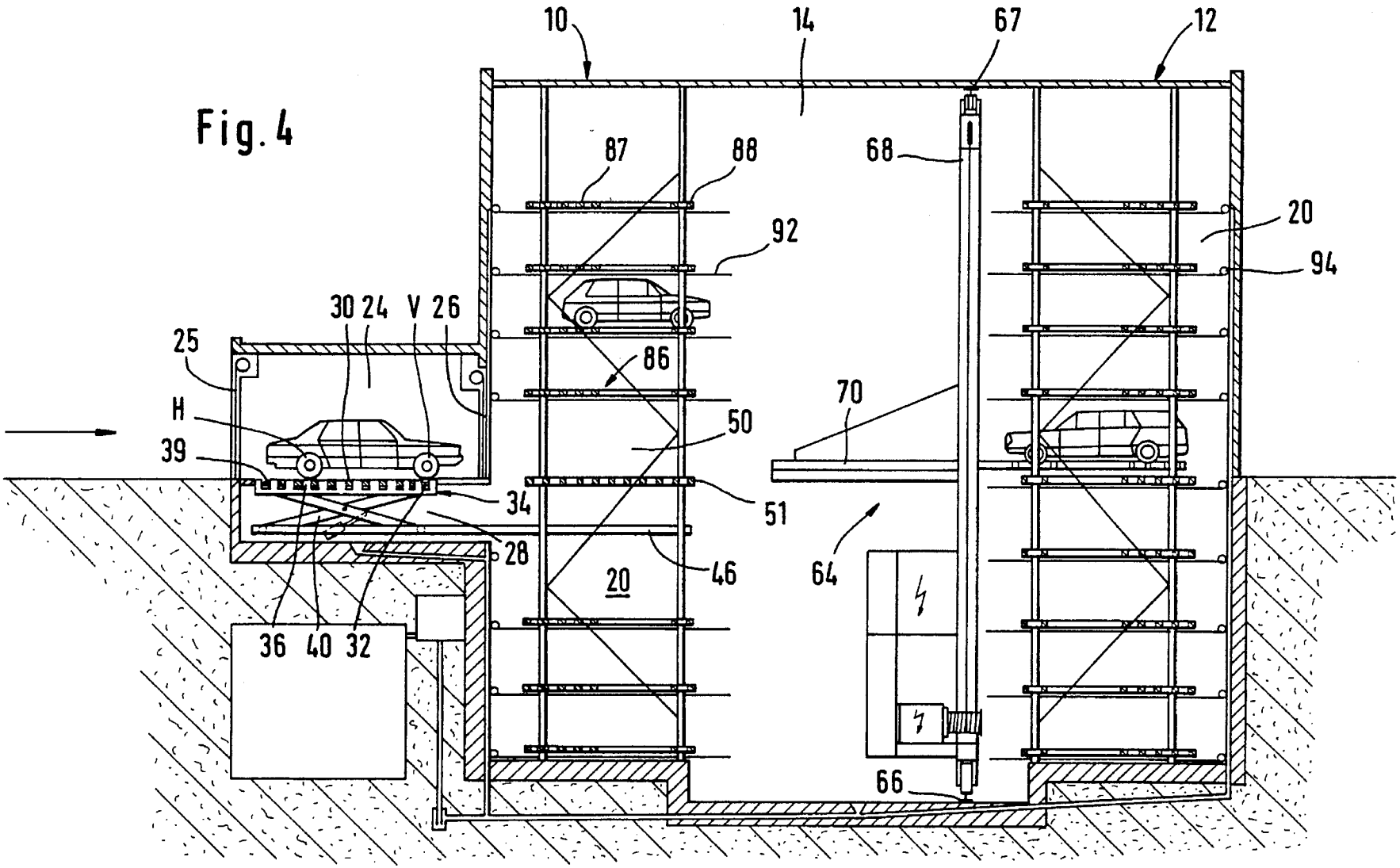
FIG. 4 is a partly underground parking device showing an E/D station arranged at normal level, similar to FIG. 3.
Figure 5:
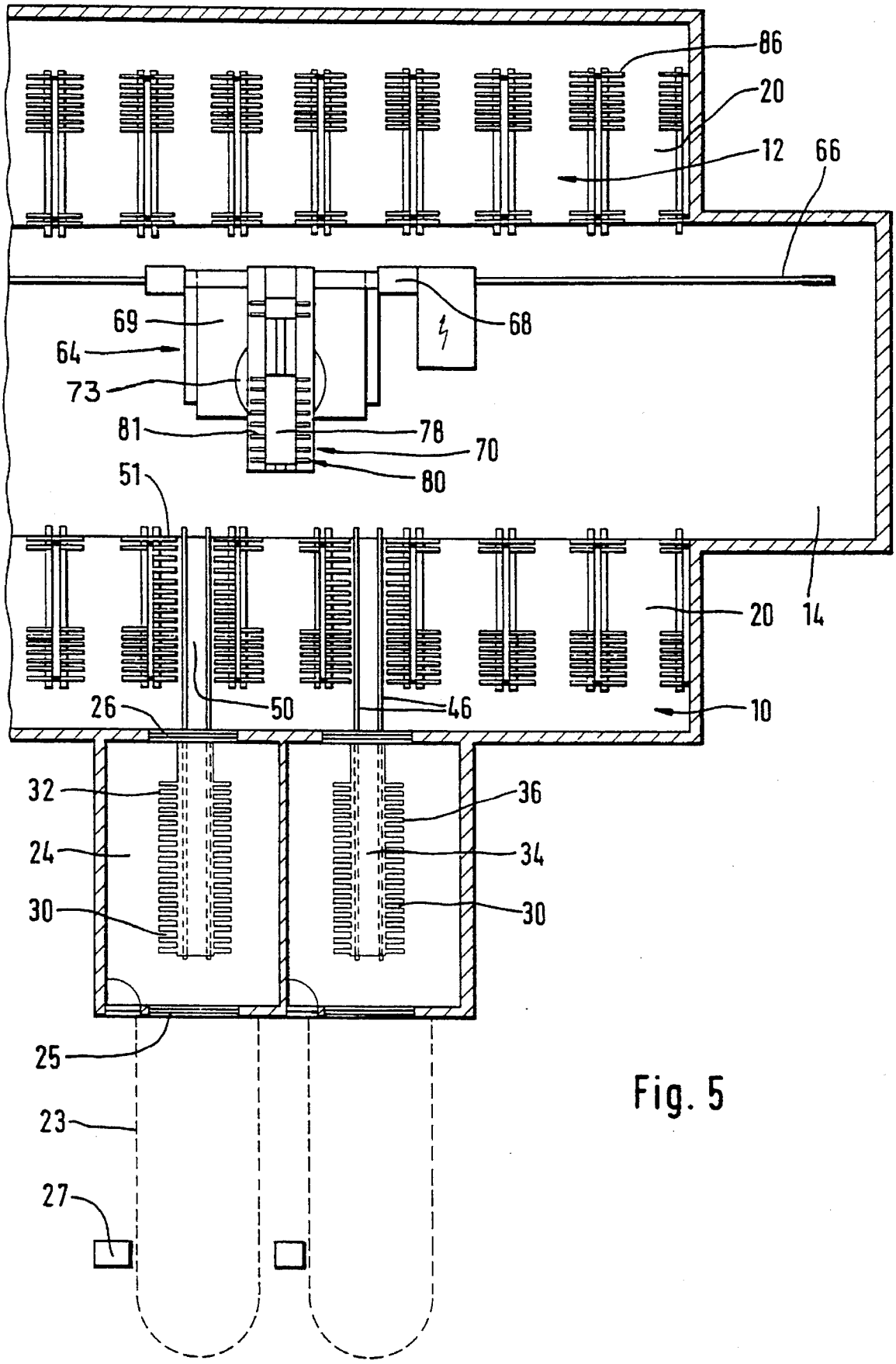
FIG. 5 is a horizontal section of the parking device as in FIG. 4 at the height of the entrance level.

With reference to FIG. 4 and 5, an incoming car activates the opening mechanism of rolling gate 25 by driving over an induction loop 23 and proceeds to the E/D station 24 up to a position pre-determined for the front wheels. The driver leaves station 24 and takes a parking ticket from automatic ticket dispenser 27, whereupon rolling gate 25 closes, after sensors installed in station 24 have checked the car dimensions as to height and other factors and determined a suitable parking box, which is printed onto the parking ticket.

Figure 6:
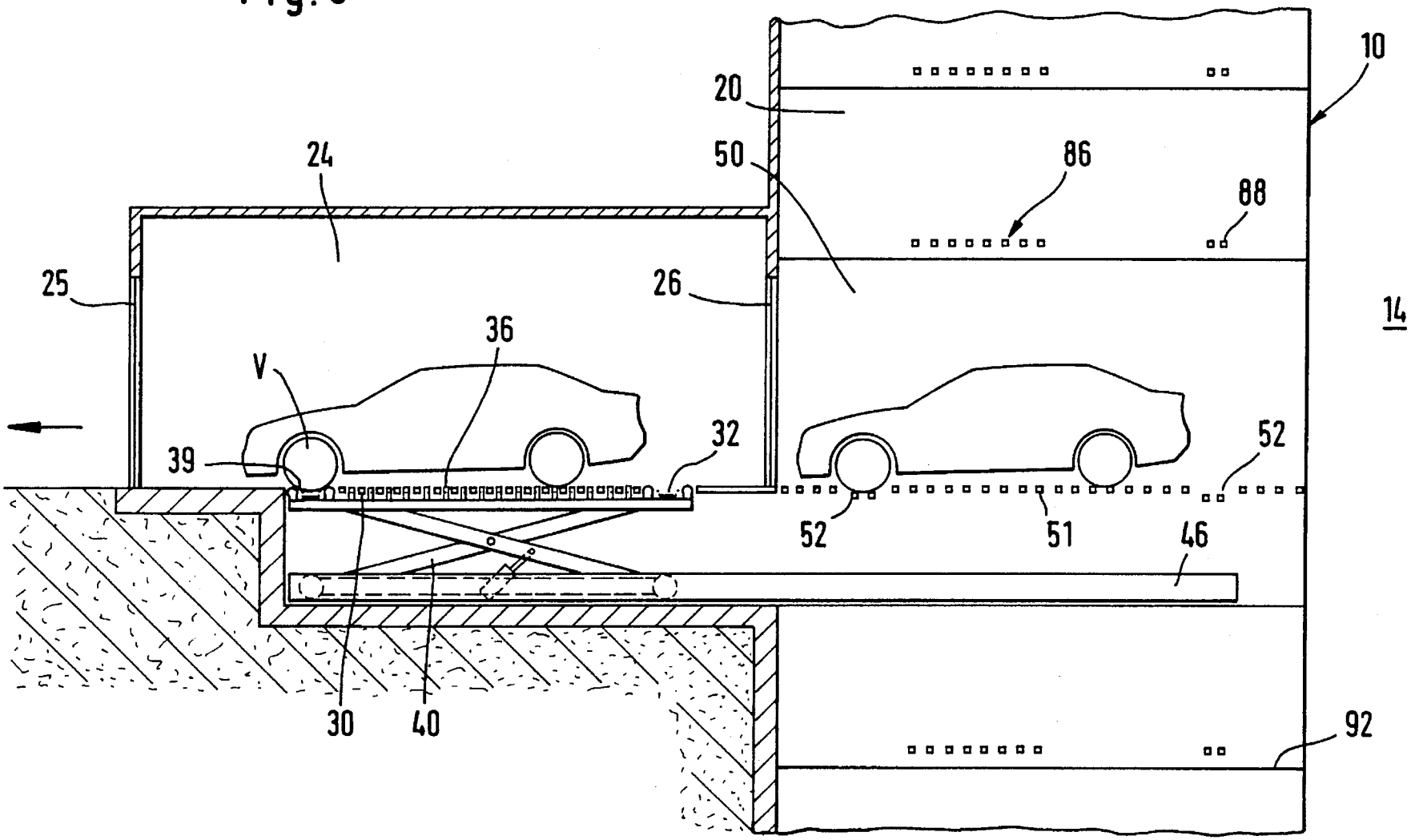
FIG. 6 is an enlarged sub-area of the parking device of FIG. 4 showing E/D station and transition place.

In station 24 a pit 28 is covered by rest combs 30 consisting of horizontal prongs arranged in the two car track areas, and projecting from both sides of the pit boundary. For positioning the front wheels the rest combs 30 include receiving means 32, may be in the form of a troughed profile or of increased prong intervals (FIG. 6). Sensor and signalling means 56, 57, respectively, may be provided as a replacement for, or as an addition to, the receiving means 32 of the rest combs 30 for positioning the front wheels. The central free area between the combs serves for receiving and for moving through shiftable lifting table 34, on both sides of which are fastened transport combs 36 projecting into the car track area, and consisting of prongs; the transport combs 36 are in staggered positioned such that they fit into the prong intervals of the rest combs 30 and together with then form a widely closed rest or placing area. The transport combs 36 also comprise prongs 37 with a large interval serving to position the front wheels and to take up the above mentioned channel or trough profile or two prongs serving as receiving means 32 and having a smaller interval but still adequate for the purpose of wheel positioning.

For a larger parking device with several E/D stations in accordance with FIG. 1, some of these can be used, temporarily or permanently, either only for parking or retrieving. In the example of FIG. 6, outgoing cars are turned through 180 degrees and delivered to a station 24 which is designed for parking and retrieving. For the purpose of safe conveying the transport combs 36 of the shiftable lifting table 34 comprise front and rear prongs 37 and 39, respectively, with large intervals, whereby the rear receiving prongs 39 also interact with the rest combs 30.

The shiftable lifting table 34 is supported in the pit 28 by means of articulated hoisting scissors 40 on a base frame, which can be moved by means of rollers 44 on horizontal rails 46 by actuating a drive, not illustrated. At least one lifting cylinder 49 operating between base frame 43 and articulating hoisting scissors 40 is provided for the vertical movement of the shiftable lifting table 34.

For movement of a car positioned for parking in the E/D station 24, in the example in FIG. 4, the shiftable lifting table 34 will be lifted above the rest combs 30 and then moved on its rails 46 into a stop position, at which it stands above a transition place 50 installed in rack 10 preferably at the same height as the rest combs 30. In this position the shiftable lifting table 34 is lowered through resting combs 51 fixed on both sides of rack 10, projecting into the track areas and having forward and rear positioning means 52 as shown in FIG. 6 so that the car remains standing on the transition place 50. The shiftable lifting table 34 then reaches its lowermost end position, from which it is returned to the E/D station, elevated and indexed and/or locked in flush alignment to the rest combs 30. After the front rolling gate 25 has closed, the rear rolling gate 26 remains open until the shiftable lifting table stands with the car above the transition place 50.

Figure 13:
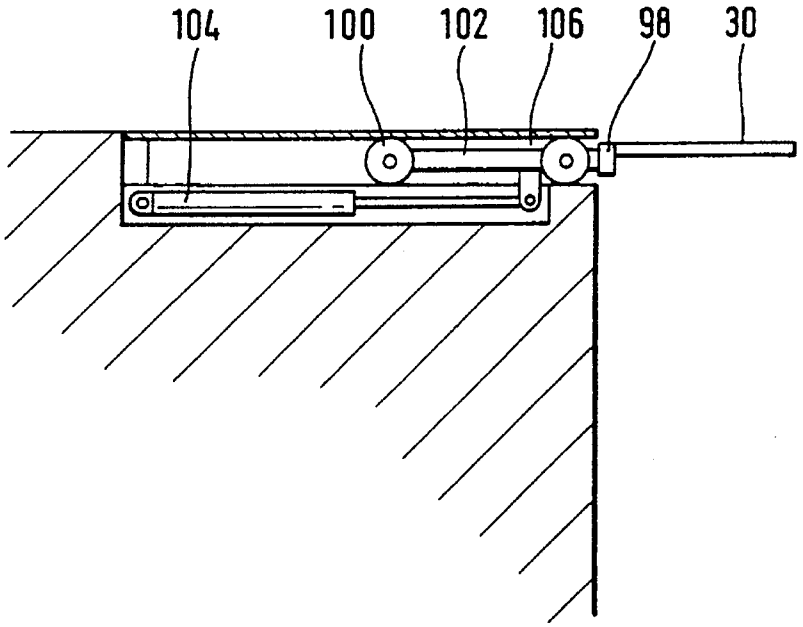

Corresponding to FIG. 3, a car placed for parking on the rest combs 30 for being proceeded into the parking system, first must be lowered into pit 28, which, for this purpose, is deeper than that shown in FIG. 4 and is suited to the length and width of the largest car dimensions. The articulated hoisting scissors 40 are designed to provide for the increased hoisting height and have articulated links, which are rotatably supported on the shiftable hoisting table 34 and on the base frame 43, respectively, by means of joint pins 42 and additional articulated links which are displaceably and rotatably supported by means of joint pins 45 in horizontal slots 48 of the shiftable hoisting table and at base frame, respectively. In order to take over a car from the rest combs 30, the shiftable hoisting table 34 is raised slightly from its indexed rest position at the height of the rest prongs until the front wheels have been positively received in the positioning space between prongs 37. The rest combs 30, now relieved from the vehicle will be either moved horizontally sideways out of the pit or swung downwards into the pit, as shown in FIG. 13.

As soon as the rest combs 30 have opened the pit 28, the shiftable hoisting table 34 with the car on it is lowered to a height at which its transport combs 36 are above the level of the transition place 50 installed in the adjacent rack. From this position, further conveyance of the car into and out of the subsequent parking device takes the same course as that shown in FIG. 4. When the shiftable lifting table 34 has been lowered down through the rest combs 51 of the transition place and has delivered the car, it reaches its lowermost position, from which it is driven return to pit 28, elevated and indexed in flush alignment with rest combs 30. Conventional indexing means are provided to fix the shiftable lifting table 34 at the height of the rest combs 30 and so relieve its lifting means. If the rest prongs 30 are removable the indexing means may be formed by limit stops J mounted to the rest prongs and construed to support at least two transport prongs 36 from below. Generally, such indexing means may consist of horizontally movable, preferably servo-operated, bolts which are supported at the pit wall or by the rest combs 30 and in their protruding position act to support the shiftable lifting table or its transport prongs 36 or to engage receiving means located there.

Figure 11:
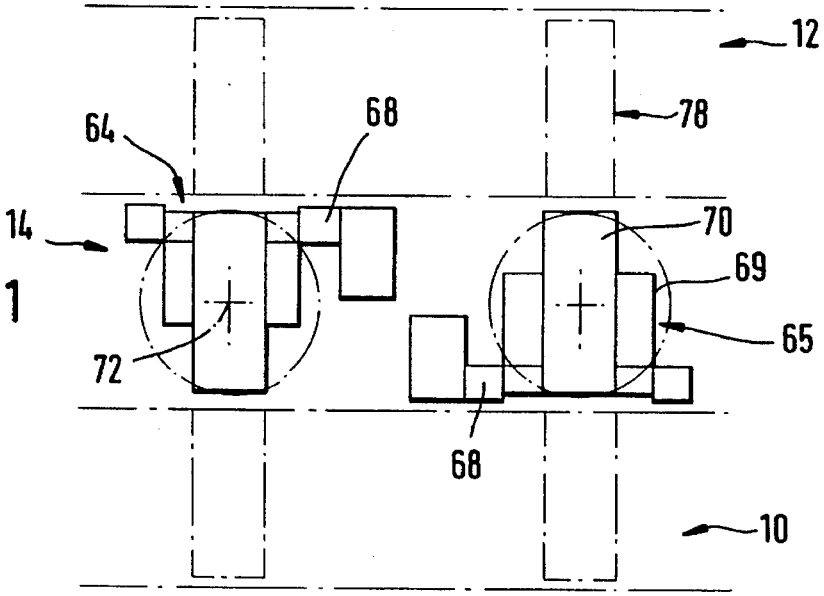
FIG. 11 is a top view of the two hoisting appliances as in FIG. 9, FIG. 12 a vertical section through another embodiment of the parking device in accordance with the invention showing an E/D station disposed above the conveying floor.

A hoisting appliance 64 is movable along the conveying floor 14 extending between the two racks 10, 12, with its mast 68 guided in upper and lower rails secured to the ground and to the ceiling of the park roof. FIG. 1 and 11 show adjacently disposed pairs of rails for at least two hoisting appliances 64, 65 which are movable past each other. Each hoisting appliance includes a vertically adjustable hoisting platform 69 guided on one or two vertical masts 68 and mounting a horizontally adjustable conveying table 70, which is rotatable through at least 180 degrees.

Each conveying table 70 of substantially rectangled periphery is rotatable about its vertical pivot axis 72 at the center of turntable 73 into differing angular positions such that its longitudinal (longer) sides either run parallel to the direction of the floor 14 or, after rotation 90° degrees, transverse to the floor 14. In the first mentioned angular position of the conveying table, sufficient clearance space is left at its longitudinal side, opposite to the adjacent rack 10, up to the masts 68 of the hoisting appliance guided on the other pair of rails, so that the two hoisting appliances 64, 65 can pass each other, if their conveying tables 70 are staggeredly adjusted to different heights.

Figure 10:
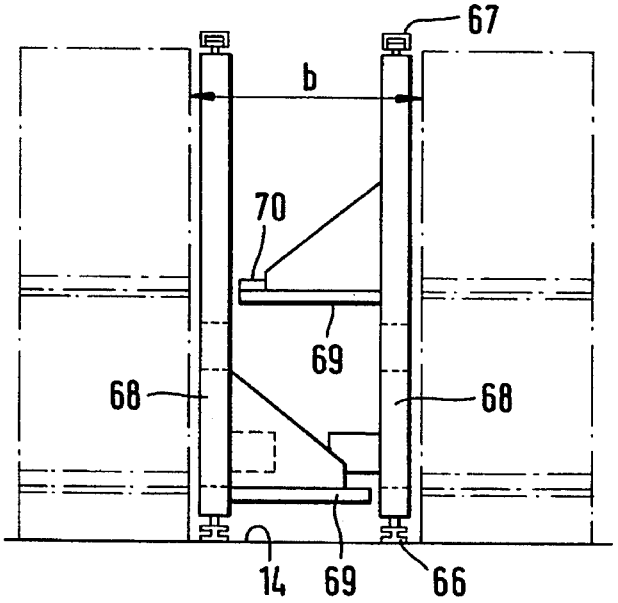
FIG. 10 is a simplified front view of the hoisting appliances guide in different pairs of rails as in FIG. 9.

By suitably disposing the pivot axis 72 and dimensioning the rotatable conveying table to a smallest possible width, it is possible to keep the width b (FIG. 10) of the conveying floor 14 small and thereby to reduce the necessary extension length of the telescopic conveying table 70 and also of the necessary constructional support requirements, but at the same time to house hoisting appliances 64, 65 passing each other in the floor. The rotatability of the conveying table 70 on the hoisting platform 69 can be realised means of any suitable pivot bearing, e.g. a kingpin and an additional ball bearing support or by means of a rotating track/turntable 73. One or several rotating motors or simple hydraulic cylinders, if necessary with additional kinematic lever transmission, may serve as rotating drive, since the maximum angle of rotation can be limited to 180° . The rotatability of the conveying table 70 facilitates both the housing of two hoisting appliances passing each other on a relative narrow floor, and turning of the cars whilst being conveyed such that they stand in the direction of travel for both parking and departure.

Each conveying table 70 preferably consists of three telescoping units 74, 76, 78 (FIG. 3) which are able to move the in the same or opposite directions, with adequate travel of projection to deliver a car from the transition place 50 into any parking box of the two racks 10, 12 or remove it from the same. Like the shiftable lifting table 34, the furthest extensible uppermost telescoping table unit 78 has fixed on its both sides transport combs 80 including groups of prongs forming receiving means 82 for front wheels. These transport combs are arranged for complementary combing relation with rest combs 51 and 86 of the transition place 50 and at each parking box 20, respectively. The conveying table 70 can be moved vertically and horizontally and where necessary rotationally at the displacement time of the hoisting appliance, so that the total transfer or conveyance time remains at a minimum. To take over an incoming car the conveying table 70 with its telescoping unit 78 moves under the transition place 50 and from there lifts the car with the transport combs 80 by vertical movement of the hoisting platform 69. The car positioned on the conveying table is then telescopingly moved into floor 14, turned if necessary, brought up to the pre-determined vertical group of parking boxes by movement of the hoisting appliance, moved to the height of an allocated parking box 20 by actuating the hoisting platform 69 and from there is desposited, preferably with its front facing floor 14, by telescoping and-vertical movement, onto rest combs 86 mounted at the floor level of a parking box 20.

Figure 7:
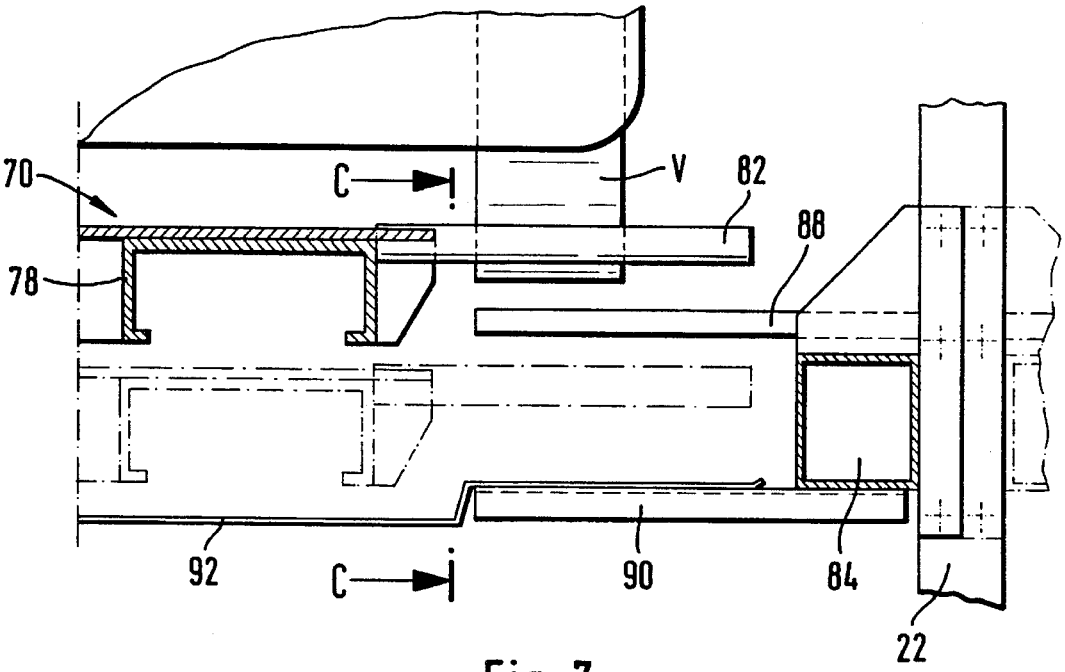
FIG. 7 is a vertical partial cross section through a parking box and an upper telescoping unit of the hoisting appliance conveying table fitted with transport prongs.
Figure 8:
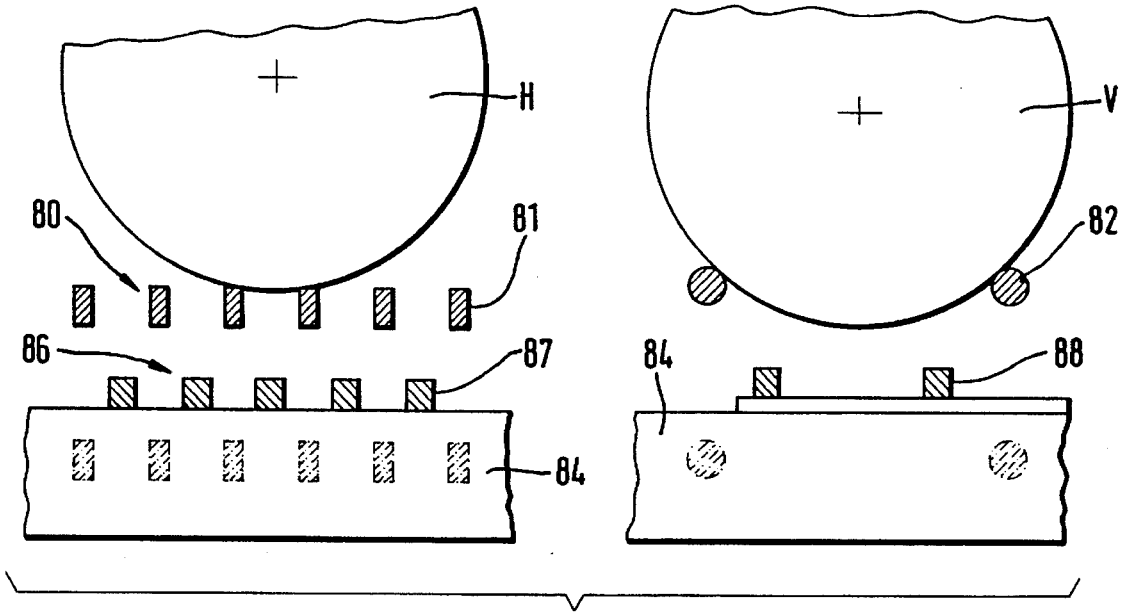
FIG. 8 is a section following line C—C in FIG. 7.
Figure 9:
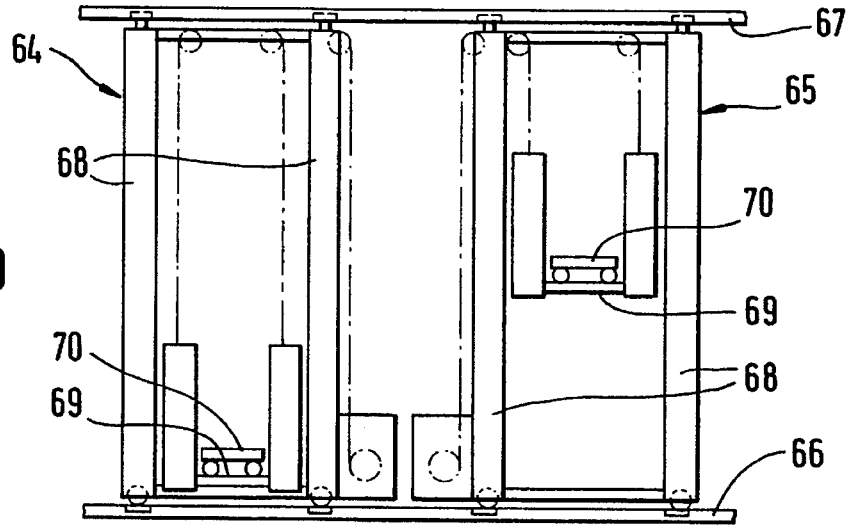
FIG. 9 is a simplified view of two hoisting appliances which move longitudinally in the conveying floor.

The take-over and/or delivering operations for a car effected for example as in FIG. 5 by the transport combs 80 of the conveying table 70 in a parking box 20, are illustrated in detail in FIG. 6 to 8. The transport combs 80 fixed to both sides of the telescoping unit 78 each comprise a larger group of prongs 81 for support of the rear wheels H and at least two front prongs 82 having a larger distance between for positive positioning the front wheels. It may be appropriate to mount the positioning prongs 82 on the telescoping unit 78 slightly higher than the rear group of prongs 81, so that when lifting a car from the rest combs of a transition place or a parking box, the front wheels are gripped into position first, The rest combs 86, as in FIG. 5 and 7, are foxed on both sides of a parking box 20 to horizontal beams 84 connected to vertical beams 22. Each rest comb comprises two front prongs 88 with a distance between adequate to position the front wheels V, which prongs also may be replaced by a suitable channel or trough profile. According to FIG. 8 two front rest prongs 88 fit into the distance between positioning prongs 82 of transport comb 80. The larger group of prongs 81 is long enough to support the rear wheels H cars of any wheel base. FIG. 7 and 8 show by full lines transport combs loaded with a car above the rest combs 86 at a height at which they will be telescopingly projected into the parking box by means of the conveying table. The position below the rest combs 86 shown by interrupted lines corresponds to the height of the conveying table, which it assumes after having deposited the car in a parking box 20 and before it will be telescopingly retracted. Below the rest combs 86, drip plates 92 are provided, placed on or bolted to support members 90, which are inclined downwards from the floor side of each parking box to drain into a lower common drip channel for disposal of collected fluids.

Figure 12:
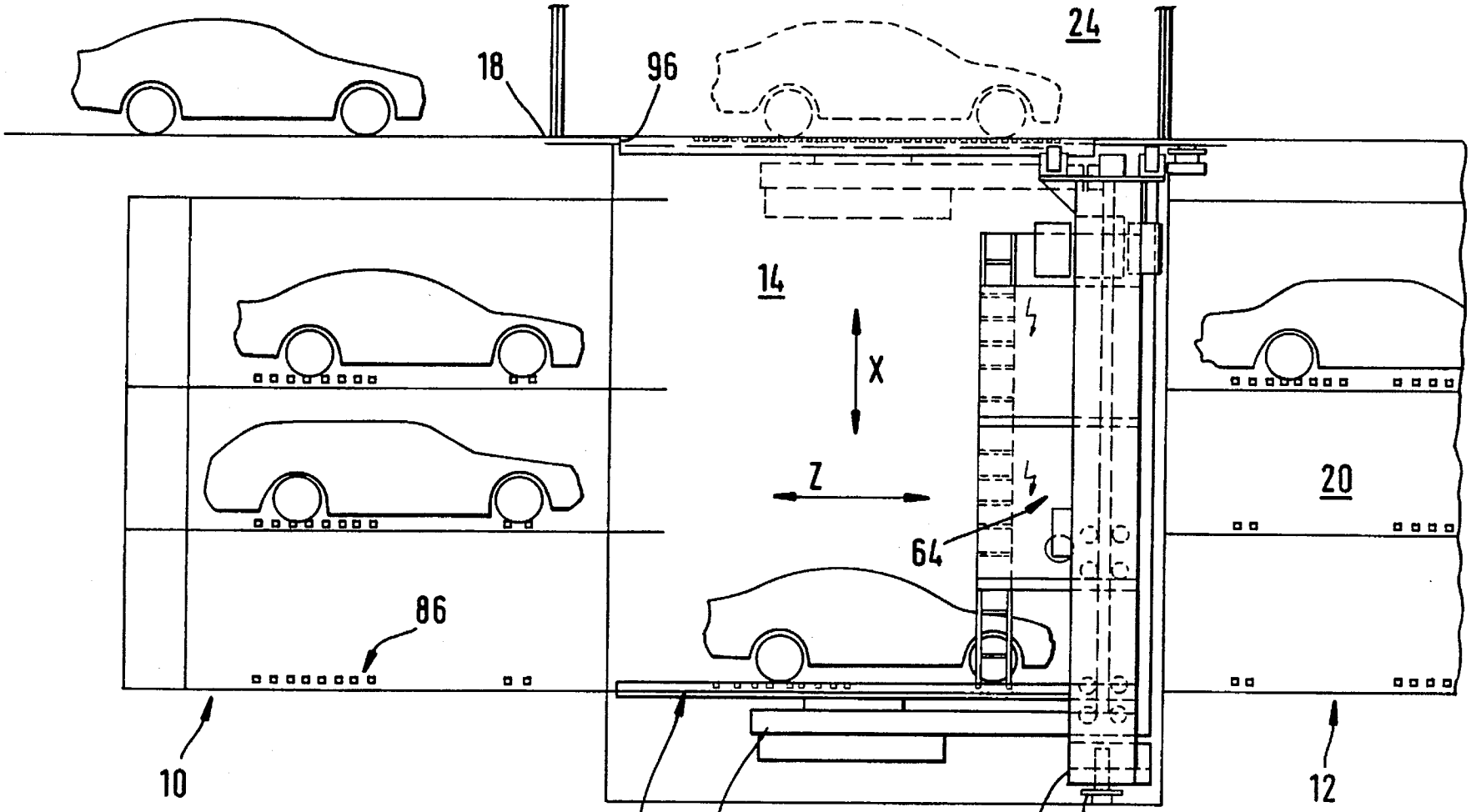
Figure 14:
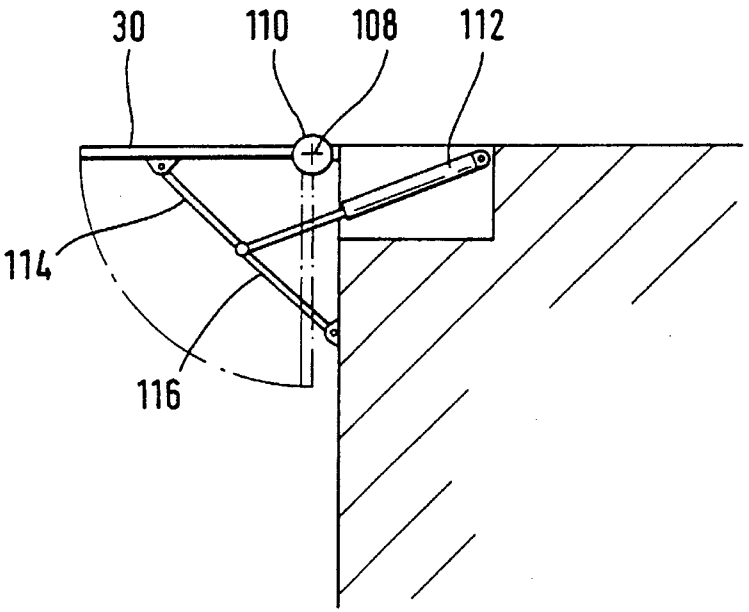
FIGS. 13 and 14 are vertical cross-sections through the pit of an entrance and departure station shown in FIG. 3, showing two variants for adjustment of the rest combs.

FIG. 12 shows a simplified embodiment of a parking device in accordance with the invention, which neither needs a shiftable lifting table nor a transition place. As before, a hoisting appliance 64, its masts 68 being guided in upper and lower rails, can be moved longitudinally in a conveying floor 14 between two high storage racks 10, 12 shown only with their upper rows of parking boxes. A hoisting platform 69 is vertically adjustable on masts 68 and supports a conveying table 70 arranged for telescoping movement, horizontally and transverse with respect to the floor and having fixed transport combs 80 on both sides for delivering and receiving a car standing on rest combs 86 in the parking boxes. The conveying table 70 is adjustable in upward direction at least up to an opening 96 provided in a passable park roof 18, in which its transport combs 80 fit flush to the upper side of the opening, covered on both sides with the rest combs 30. The opening 96 is located, similar to pit 28 of FIG. 3, inside of an entrance and departure station 24 on the passable park roof 18, and its width and length being appropriate for the largest dimensions of incoming cars. The passable roof 18 can be at the normal ground level or, if projecting over ground, can be reached by a not shown access ramp.

Before a car is lowered from station 24 for transfer into the parking system or is retrieved for departure, the rest combs 30 must be removed from the opening 96. For this purpose, principle, the same adjusting means shown in FIG. 13 can be used as for the rest combs 30 covering the pit 28 in FIG. 3, and which will become effective either to move the rest combs sidewards from the pit 28 or from the opening 96 or to swing them downwardly. For a sideways movement, the rest combs 30 and/or their prongs are fixed to a common beam 98, to which laterally extending guide members 102 are fixed fitted with rollers 100. The guide members 102, when moved by means of hydraulic cylinders 104, toothed belt or chain drives, or rack and pinion drives, run with their rollers 100 in rail profiles 106 underground the floor of the E/D station 24, which includes a receiving space for the retracted rest combs 30 covered by passable plates. Suitably, guide members 102 are fixed near or at the ends of support beam 98 outside beyond the comb length so that the rails 106 lie outside of the comb shifting path and so may extend up to the pit or opening.

According to the variant shown in FIG, 14, rest combs 30 are rotatably mounted on horizontal pivot axes 108 to be adjusted between a horizontal closing position and a clearing position when swung downwards. Each comb 30 comprises a multiply supported carrier beam 110 for its prongs or groups of prongs, which are strutted at the pit wall or opening wall by means of toggle joint levers 114, 116 actuated by hydraulic cylinder 112. The toggle joint levers 114, 116 can be folded together to the hinged-down position of rest combs 30.

We claim:

1. A parking device for cars, comprising: a floor;

vertical racks erected on both sides of the floor, the racks containing parking bays or boxes arranged adjacently and above each other in several levels, the parking boxes having rest areas formed by a comb system consisting of stationary rest combs, and one of the parking boxes forming a transition place;

a hoisting appliance movable upon the floor between the vertical racks, the hoisting appliance having a conveying table to one side of the parking boxes, the table being provided with transport combs complementary to the stationary rest combs of the parking boxes for the purpose of receiving, transferring and discharging a car, which transport combs may vertically traverse the stationary rest combs of the parking boxes;

an entrance and departure station disposed to one side of the vertical rack including the parking box forming a transition place, the station being provided with stationary rest combs; and a shiftable lifting table disposed adjacent the parking box which forms a transition place and below the entrance and departure station, the shiftable lifting table being provided with transport combs complementary to the stationary rest combs of the entrance and departure station and the transition place, which shiftable lifting table may carry out horizontal and vertical movements between the transition place and the entrance and departure station.

2. The parking device as set forth in claim 1 wherein the entrance and departure station and each of the parking boxes are provided with side support members, wherein each of the stationary rest combs are made up of two groups of prongs arranged in car track areas and which extend from the side support members up to a central free area, and wherein the transport combs of the hoisting appliance and the shiftable lifting table project into the car track areas and are staggered with respect to the stationary rest combs.

3. The parking device as set forth in claim 1 in which two or more entrance and departure stations are disposed to the side of one or more of the vertical racks, and wherein there is a transition place associated with each of the entrance and departure stations.

4. The parking device as set forth in claim 1 in which the hoisting appliance is mounted for longitudinal movement by a pair of rails, wherein the hoisting appliance has one or two masts, the conveying table being guided on the one or two masts, and wherein the conveying table includes a telescoping part which may be moved horizontally.

5. The parking device as set forth in claim 4 wherein the transport combs of the conveying table are mounted on the telescoping part, the transport combs of the conveying table extending to the sides of the telescoping part.

6. The parking device as set forth in claim 1 wherein the conveying table is mounted for rotational movement by at least 180° about a vertically extending axis.

7. The parking device as set forth in claim 6 wherein two hoisting appliances are movable upon the floor between the vertical racks, which hoisting appliances may pass each other, the conveying table on each hoisting appliance having a telescoping part which, when viewed from the top, has a substantially rectangular shape, and which in one of its rotated positions is aligned with its long sides parallel to the direction of movement of the hoisting appliance upon the floor and in a second position of rotation is aligned with its shorter sides parallel to the direction of movement of the hoisting appliance.

8. The parking device as set forth in claims 2 wherein the transport combs of the hoisting appliance and of the shiftable lifting table have first receiving means formed by larger prong intervals to position at least the front wheels of a car, and in that the rest combs of the parking boxes and the entrance and departure station also have receiving means which consist of prongs disposed at smaller distances from each other open to fit between the first receiving means.

9. The parking device as set forth in claim 8 wherein the prongs of the receiving means of the entrance and departure station are vertically adjustable.

10. The parking device as set forth in claim 1 in which the vertical racks extend above and below the entrance and departure station, and wherein the transition place is located at the same level as the entrance and departure station.

11. The parking device as set forth in claim 1 in which the shiftable lifting table includes hoisting means for raising and lowering the transport combs of the shiftable lifting table, the hoisting means includes an upper table, a base frame, a scissor structure between the upper table and the base frame, and cylinder means for operating the scissor structure, the base frame being horizontally movable between a position below the entrance and departure station and a position below the transition place.

12. The parking device as set forth in claim 11 characterized in that, in the case of the vertical racks being disposed entirely below ground, at least one entrance and departure station is provided above ground, the entrance and departure station having a pit suitably dimensioned for the largest anticipated car dimensions of length and width, the shiftable lifting table being disposed in the pit, the transport combs of the shiftable lifting table being movable from a raised position at the entrance and departure station to a lowered position where they may be moved horizontally to a transition place.

13. The parking device as set forth in claim 12 wherein the pit has sidewalls, wherein the stationary rest combs of the entrance and departure station are retractable into the sidewalls of the pit by guided driving means.

14. The parking device as set forth in claim 12 wherein the stationary rest combs of the entrance and departure station are pivotable downwardly into the pit.

15. The parking device as set forth in claim 1 wherein sensor and signalling device are provided in the entrance and departure station for positioning the front wheels of a car.

16. The parking device as set forth in claim 13 wherein the shiftable lifting table is adjustable in the entrance and departure station to a fully raised position located above ground, in which the retractable rest combs can be adjusted freely between released and closed positions with respect to the pit.

17. The parking device as set forth in claim 1 wherein drip plates are fixed in the parking boxes below the stationary rest combs and are inclined downwardly away from the conveying floor to drain into common disposal gutters.

18. A parking device for cars, comprising: a floor;

a roof disposed over the floor;

vertical racks erected on both sides of the floor, the racks containing parking bays or boxes arranged adjacently and above each other in several levels, the parking boxes having rest areas formed by a comb system consisting of stationary rest combs;

a hoisting appliance movable upon the floor between the vertical racks, the hoisting appliance having a conveying table mounted for vertical movement to one side of the parking boxes, the table being provided with transport combs complementary to the stationary rest combs of the parking boxes for the purpose of receiving, transferring and discharging a car, which transport combs may vertically traverse the stationary rest combs of the parking boxes; and an entrance and departure station provided on the roof, the station being provided with stationary rest combs, which stationary rest combs may be moved from a position where they may support a car to a retracted position, the transport combs of the conveying table being adapted to pass through the stationary rest combs of the entrance and departure station when the transport table is raised to its highest raised position.

19. The parking device according to claim 18 wherein the stationary rest combs may be swung downwardly from a support position to a retracted position.

* * * * *